US011800272B2

(12) United States Patent
Karasawa et al.

(10) Patent No.: US 11,800,272 B2
(45) Date of Patent: Oct. 24, 2023

(54) HEADPHONE DEVICE

(71) Applicants: Sintai Optical (Shenzhen) Co., Ltd., ShenZhen (CN); Asia Optical Co., Inc., Taichung (TW)

(72) Inventors: Takayuki Karasawa, Taichung (TW); Tomoya Takahashi, Taichung (TW)

(73) Assignees: SINTAI OPTICAL (SHENZHEN) CO., LTD., Shenzhen (CN); ASIA OPTICAL CO., INC., Taichung (TW)

( * ) Notice: Subject to any disclaimer, the term of this patent is extended or adjusted under 35 U.S.C. 154(b) by 34 days.

(21) Appl. No.: 17/571,636

(22) Filed: Jan. 10, 2022

(65) Prior Publication Data

US 2022/0256269 A1 Aug. 11, 2022

(30) Foreign Application Priority Data

Feb. 9, 2021 (TW) ..... 110105103

(51) Int. Cl.
*H04R 25/00* (2006.01)
*H04R 1/10* (2006.01)

(52) U.S. Cl.
CPC ..... *H04R 1/1008* (2013.01); *H04R 1/1033* (2013.01)

(58) Field of Classification Search
CPC .. H04R 1/345; H04R 1/1016; H04R 2420/07; H04R 2225/77
See application file for complete search history.

(56) References Cited

U.S. PATENT DOCUMENTS

2005/0213774 A1* 9/2005 Kleinschmidt ..... H04R 1/1066 381/72
2009/0003616 A1 1/2009 Kleinschmidt et al.
2013/0028435 A1* 1/2013 Christoph ..... G10K 11/17854 381/71.6
2019/0200115 A1 6/2019 Huang

FOREIGN PATENT DOCUMENTS

| | | | |
|---|---|---|---|
| CA | 2783383 | A1 | 1/2013 |
| CN | 1678130 | A | 10/2005 |
| CN | 101754066 | A | 6/2010 |
| CN | 102905206 | A | 1/2013 |
| CN | 103067827 | A | 4/2013 |
| CN | 208675483 | U | 3/2019 |

(Continued)

*Primary Examiner* — Amir H Etesam
(74) *Attorney, Agent, or Firm* — McClure, Qualey & Rodack, LLP

(57) ABSTRACT

A headphone device includes a housing, a sound generator and a tube. The housing includes a main body and a cover plate. The cover plate includes a first surface and a second surface. The first surface is disposed towards the main body and connected to the main body to form an internal space. The second surface is disposed opposite to the first surface. The sound generator is disposed in the internal space. The tube includes a tubular body, a first end and a second end. The tubular body is disposed between the first end and the second end. The tubular body has a cross section which is in a closed shape. The second surface of the cover plate is disposed towards the tubular body. The tubular body and the second surface are disposed in parallel or have an included angle less than twenty degrees.

20 Claims, 6 Drawing Sheets

(56) References Cited

FOREIGN PATENT DOCUMENTS

| | | | |
|---|---|---|---|
| CN | 111314818 | A | 6/2020 |
| EP | 1587342 | A2 | 10/2005 |
| EP | 1685741 | B1 | 8/2006 |
| EP | 2552125 | B1 | 11/2007 |
| GB | 2408405 | A | 5/2006 |
| HK | 1079953 | A1 | 4/2006 |
| JP | 2005287018 | A | 10/2005 |
| JP | 2009218687 | A | 9/2009 |
| WO | 2005051037 | A1 | 6/2005 |

* cited by examiner

HEADPHONE DEVICE

BACKGROUND OF THE INVENTION

Field of the Invention

The invention relates to a headphone device, and more particularly to a headphone device using a tube which is open at one end and closed at the other end to improve the quality of sound.

Description of the Related Art

FIG. 1 depicts a conventional over-ear headphone device being worn by a user. As shown, the over-ear headphone device 1 at least includes a housing 11, an over-ear cushion 12 and a loudspeaker 13. The housing 11 generally is made of hard material (e.g. plastic or metal) and is configured to contain the loudspeaker 13. The over-ear cushion 12 is connected to the housing 11, generally is made of soft material (e.g. sponge), and is configured to contact the user's ear. The loudspeaker 13 is disposed in the housing 11 to generate sound for user's listening.

Referring to FIG. 2, the over-ear cushion 12 has an annular side portion 121. When the user wears the headphone device 1, the annular side portion 121 surrounds user's ear 3. An acoustic channel 14 is formed behind the ear 3 in the over-ear cushion 12. The sound wave generated by the loudspeaker 13 may be induced into a standing wave which affects the quality of sound. In case that the acoustic channel 14 has a length L=90 mm and the sound speed is 344 m/sec, the sound frequency f can be obtained where $f=344/(0.09\times2)=1911$ (Hz). That is, a standing wave is formed in the acoustic channel 14 when the sound frequency f=1911 (Hz).

BRIEF SUMMARY OF THE INVENTION

The invention therefore provides a headphone device wherein a tube is disposed in the ear cushion and has one end open and the other end closed. By such arrangement, the above-mentioned negative influence of the acoustic channel can be alleviated, a sound positioning in the front can be performed, and the quality of sound of the headphone device can be improved.

The headphone device in accordance with an exemplary embodiment of the invention includes a housing, a sound generator and a tube. The housing includes a main body and a cover plate, wherein the cover plate includes a first surface and a second surface, the first surface is disposed towards the main body and connected to the main body so as to form an internal space, and the second surface is disposed opposite to the first surface. The sound generator is disposed in the internal space. The tube includes a tubular body, a first end and a second end, wherein the tubular body is disposed between the first end and the second end, and the tubular body has a cross section which is in a closed shape. The second surface of the cover plate is disposed towards the tubular body. The tubular body and the second surface are disposed in parallel or have an included angle less than twenty degrees.

In another exemplary embodiment, the headphone device further includes an extension support, wherein the main body includes a circumferential portion connected to the first surface of the cover plate, the extension support includes an end portion connected to the circumferential portion, the extension support extends along the circumferential portion of the main body and outside the housing, the circumferential portion has an audio cable hole disposed opposite to the extension support, and the tube is disposed near the extension support or the audio cable hole.

In yet another exemplary embodiment, the headphone device further includes an extension support and another tube, wherein the main body includes a circumferential portion connected to the first surface of the cover plate, the extension support includes an end portion connected to the circumferential portion, the extension support extends along the circumferential portion of the main body and outside the housing, the circumferential portion has an audio cable hole disposed opposite to the extension support, and the tubes are disposed near the extension support or the audio cable hole.

In another exemplary embodiment, the headphone device further includes an extension support, wherein the main body includes a circumferential portion connected to the first surface of the cover plate, the circumferential portion has a mounting hole, the extension support includes an end portion connected to the mounting hole of the circumferential portion, the extension support extends along the circumferential portion of the main body and outside the housing, and the tube is disposed near the mounting hole.

In yet another exemplary embodiment, the headphone device further includes an extension support and an ear cushion, wherein the main body includes a circumferential portion connected to the first surface of the cover plate, the circumferential portion has a mounting hole, the extension support includes an end portion connected to the mounting hole of the circumferential portion, the extension support extends along the circumferential portion of the main body and outside the housing, and an acoustic channel is formed between the ear cushion and the cover plate and near the mounting hole when the headphone device is in use.

In another exemplary embodiment, the first end of the tube is father from the acoustic channel than the second end of the tube.

In yet another exemplary embodiment, the tube is open at the first end and is closed at the second end, and the second end of the tube is closed by glue.

In another exemplary embodiment, the headphone device satisfies at least one of following conditions: $70\ \text{mm}\leq D1\leq116\ \text{mm}$; $35\ \text{mm}\leq L\leq55\ \text{mm}$; $30\%\leq L/D1\leq79\%$, where D1 is a length of the acoustic channel, and L is a length of the tube.

In yet another exemplary embodiment, the length of the tube is 40%-63% of that of the acoustic channel.

In another exemplary embodiment, the headphone device further includes an ear cushion, a connecting portion and a tube containing portion, wherein the ear cushion includes a compression portion, the compression portion includes a third surface and a fourth surface, the third surface is disposed towards the second surface, the fourth surface is disposed opposite to the third surface, the connecting portion includes a third end and a fourth end, the third end is fixed to the compression portion, the fourth end is fixed to the housing, the tube is disposed in the tube containing portion, and the tube containing portion is disposed on the third surface of the compression portion.

In yet another exemplary embodiment, the housing further includes a central axis and a symmetric axis, the central axis extends in a direction of thickness of the housing, the symmetric axis perpendicularly intersects the central axis, the tube is open at the first end, and the first end is 10 mm-30 mm away from the central axis measured along the symmetric axis.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

After a large number research for the relationship between the direction of sound source and the trough and crest values of the head related transfer function (HRTF), it is found that the sound in a frequency band at the trough and crest values can be absorbed if a ¼ wavelength tube is disposed in the ear cushion. Accordingly, the invention is provided to adjust the diameter and length of the ¼ wavelength tube and to set up the frequency to be changed, thereby eliminating or reducing the standing wave formed behind user's ear, performing the sound positioning in the front, and improving the quality of sound of the headphone device. In an example, the sound speed c=344 m/sec. The length of the ¼ wavelength tube L=45 mm. The diameter of the ¼ wavelength tube φ=4 mm. According to the formula of resonant frequency:

$$Fn=c/(4L)\times n, \text{ where } n=1,3,5 \ldots .$$

it is obtained that the first resonant frequency is 1911 Hz, the second resonant frequency is 5733 Hz, and the third resonant frequency is 9555 Hz. The research shows that the second resonant frequency and the third resonant frequency react in the vicinity of the trough values (6 kHz and 9 kHz) to eliminate the standing wave and improve the sound positioning in the front.

Figure 3:
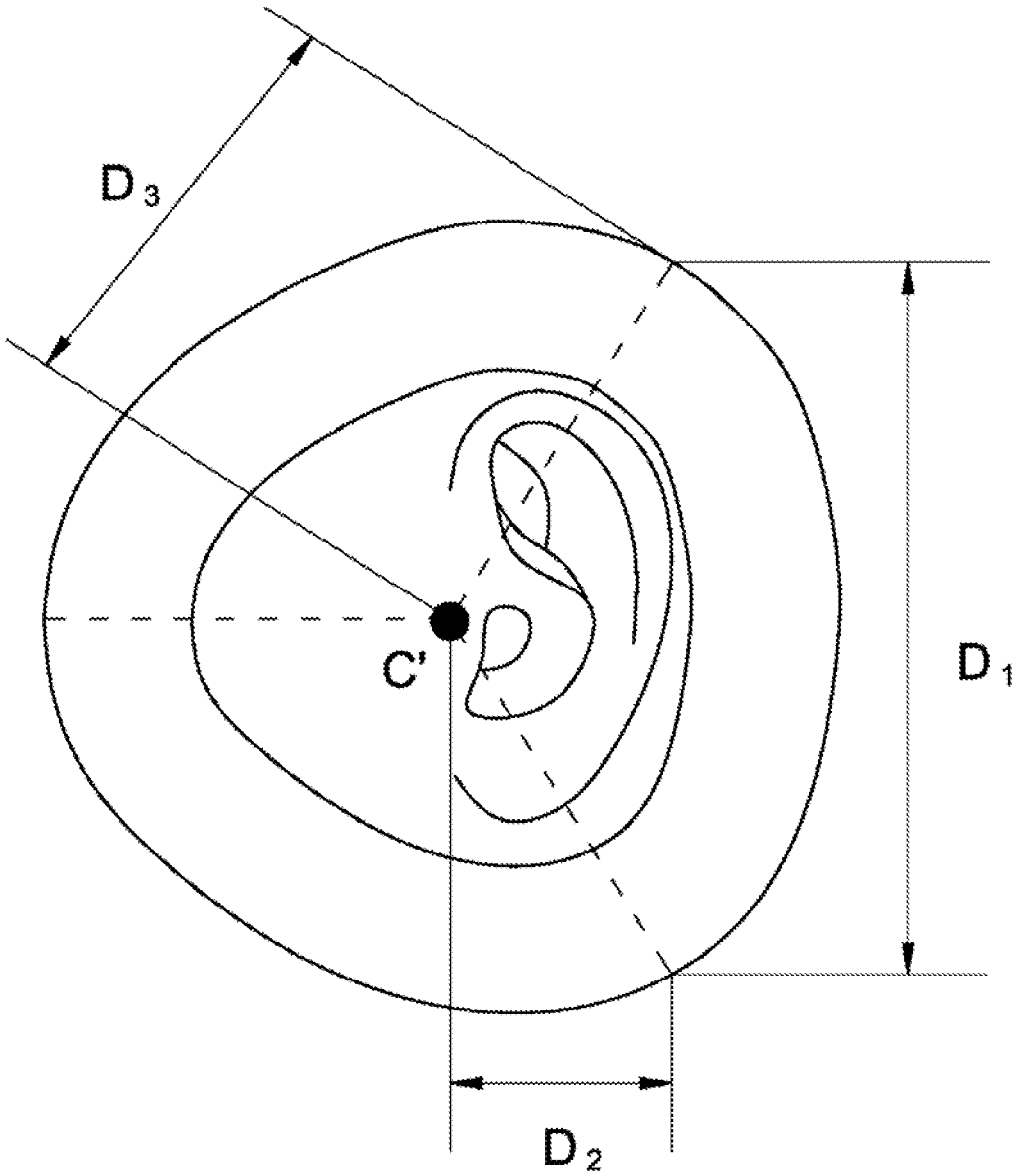
FIG. 3 depicts the design of the tube (¼ wavelength tube) of the headphone device of the invention.

FIG. 3 is used to describe the design of the tube (¼ wavelength tube) of the headphone device of the invention. In design, a headphone device is divided into three equal parts (120° for each part), and the dimensions $D_1$, $D_2$ and $D_3$ of the headphone device can be obtained accordingly. The dimensions of different headphone devices are shown in Table 1 below.

TABLE 1

| | $D_1$ | $D_2$ | $D_3$ |
|---|---|---|---|
| Dimensions of Headphone Device | 87.50 mm | 25.26 mm | 50.52 mm |
| Dimensions of Headphone Device | 105 mm | 30.31 mm | 60.62 mm |
| Dimensions of Headphone Device | 70.00 mm | 20.21 mm | 70.01 mm |
| Dimensions of Headphone Device | 115.50 mm | 33.34 mm | 66.69 mm |

Figure 2:
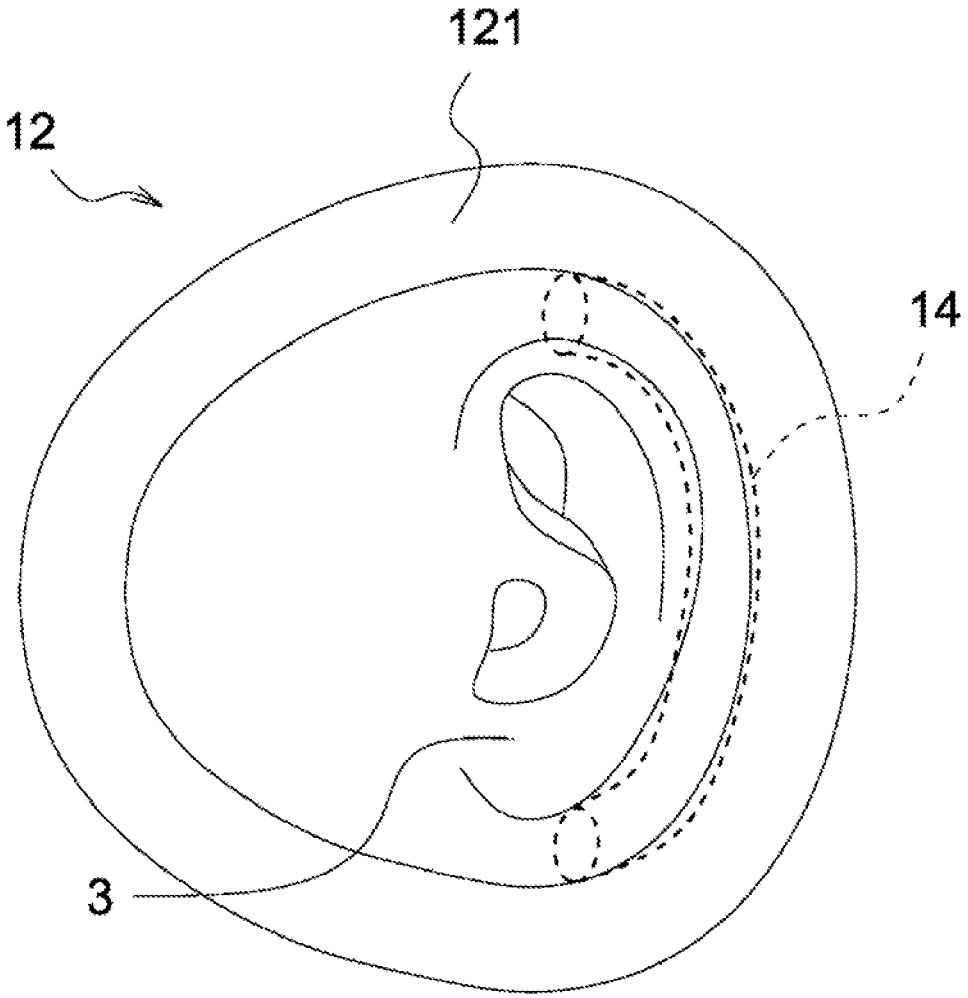
Fig. 2 (PRIOR ART)
FIG. 2 is a right side view of the conventional headphone device of FIG. 1.

The dimension $D_1$ is respectively 87.5 mm, 105 mm, 70.00 mm and 115.50 mm, which is approximately equal to the length of the acoustic channel formed behind the ear in the headphone device (the acoustic channel 14 is represented by broken lines in FIG. 2). It is found that the acoustic channel satisfies 70 mm $D_1$ 116 mm. In the invention, the length L of the ¼ wavelength tube satisfies 35 mm 55 mm, and the diameter φ of the ¼ wavelength tube ranges from 2 mm to 4 mm. Therefore, the ratio of the length of the ¼ wavelength tube to the length of the acoustic channel can be obtained from:

$$L/D_1=(35 \text{ mm to } 55 \text{ mm})/87.5 \text{ mm}=30\%\leq L/D1\leq 79\%,$$

namely the length of the ¼ wavelength tube is 30%-79% of the length of the acoustic channel in the invention.

The structure of the headphone device of the invention is described in detail below.

Figure 4:
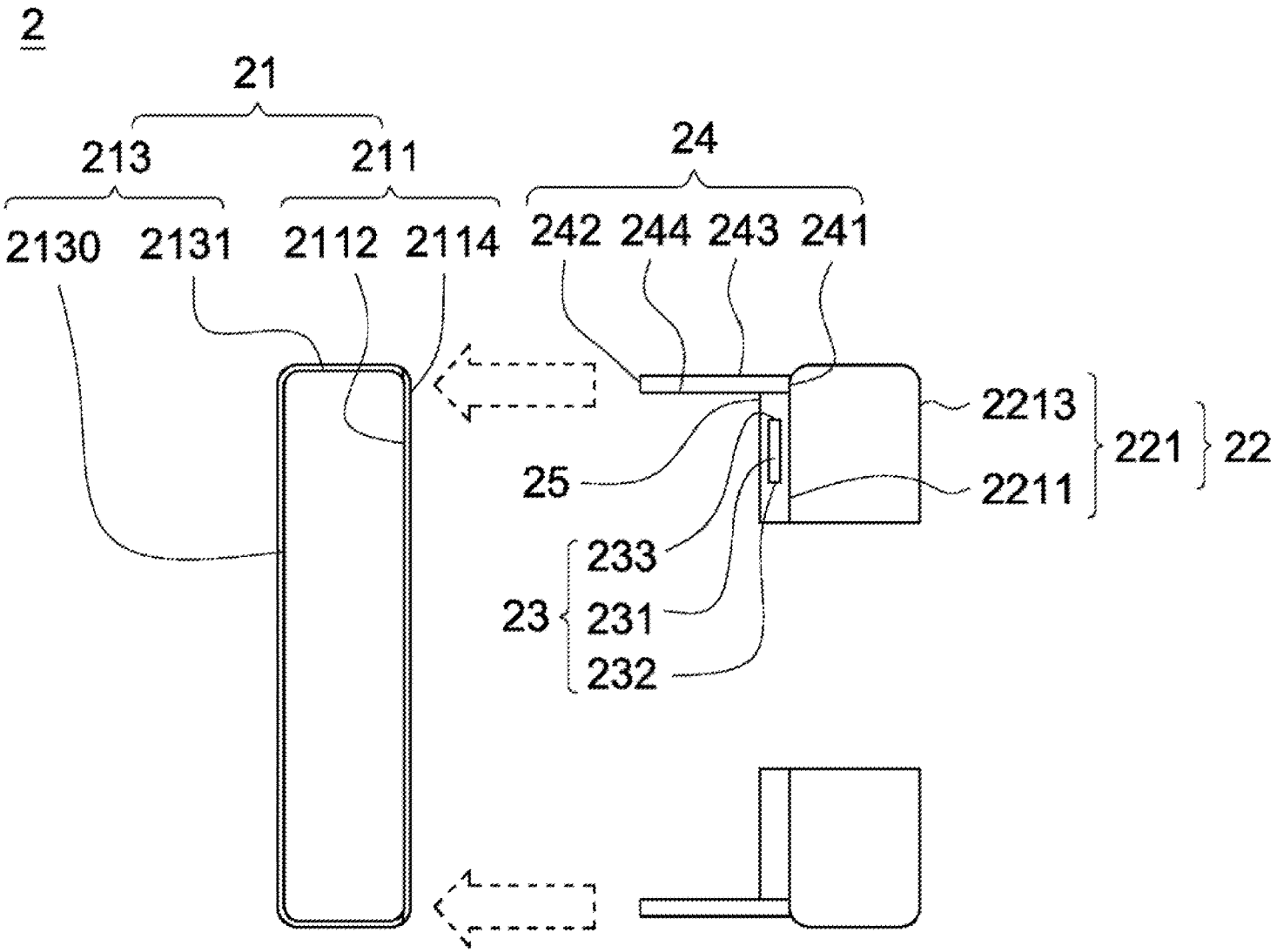
FIG. 4 is an exploded diagram of the headphone device in accordance with the invention.

FIG. 4 is an exploded diagram of the headphone device in accordance with the invention, wherein the headphone device 2 at least includes a housing 21, an ear cushion 22, a connecting portion 24, a tube 23, a tube containing portion 25 and a sound generator (not shown). The sound generator may include one or more loudspeakers (e.g. a tweeter, a woofer and/or a crossfeed loudspeaker).

The housing 21 is made of hard material (e.g. plastic or metal) for containing the sound generator. The housing 21 includes a main body 213 and a cover plate 211. The cross section of the main body 213 is substantially U-shaped and includes a bottom portion 2130 and a circumferential portion 2131. A side of the circumferential portion 2131, connected to the bottom portion 2130, is a closed side, while another side of the circumferential portion 2131 opposite to the closed side is an open side. The cover plate is disposed at the open side of the circumferential portion 2131. The cover plate 211 includes a first surface 2112 and a second surface 2114. The first surface 2112 is disposed towards the main body 213 and is connected to the main body 213 to form an internal space of the housing 21. The described sound generator is disposed in the internal space to generate sound for user's listening. The second surface 2114 of the cover plate 211 is disposed opposite to the first surface 2112 of the cover plate 211.

The ear cushion 22 is made of soft material (e.g. sponge) for contacting user's ear. The ear cushion 22 includes a compression portion 221. The compression portion 221 includes a third surface 2211 and a fourth surface 2213. The third surface 2211 is disposed towards the second surface 2114 of the cover plate 211, while the fourth surface 2213 is disposed opposite to the third surface 2211.

The connecting portion 24 includes an inner circumferential surface 244, an outer circumferential surface 243, a third end 241 and a fourth end 242. The inner circumferential surface 244 is disposed closer to the sound generator than the outer circumferential surface 243. The third end 241 is fixed to the compression portion 221. The fourth end 242 is fixed to the second surface 2114 of the cover plate 211 or the circumferential portion 2131 of the main body 213.

Figure 1:
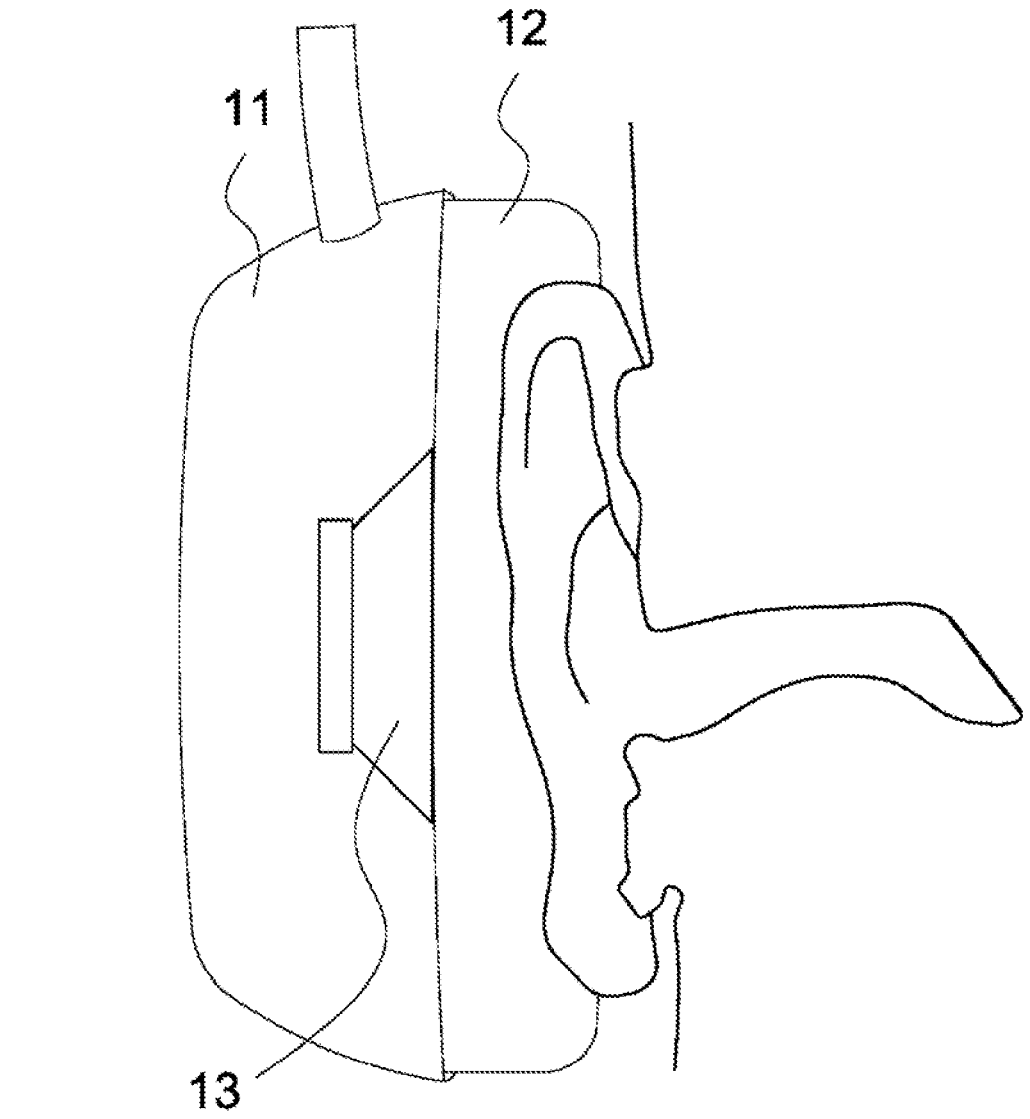
Fig. 1 (PRIOR ART)
FIG. 1 depicts a conventional over-ear headphone device being worn by a user.
Figure 6:
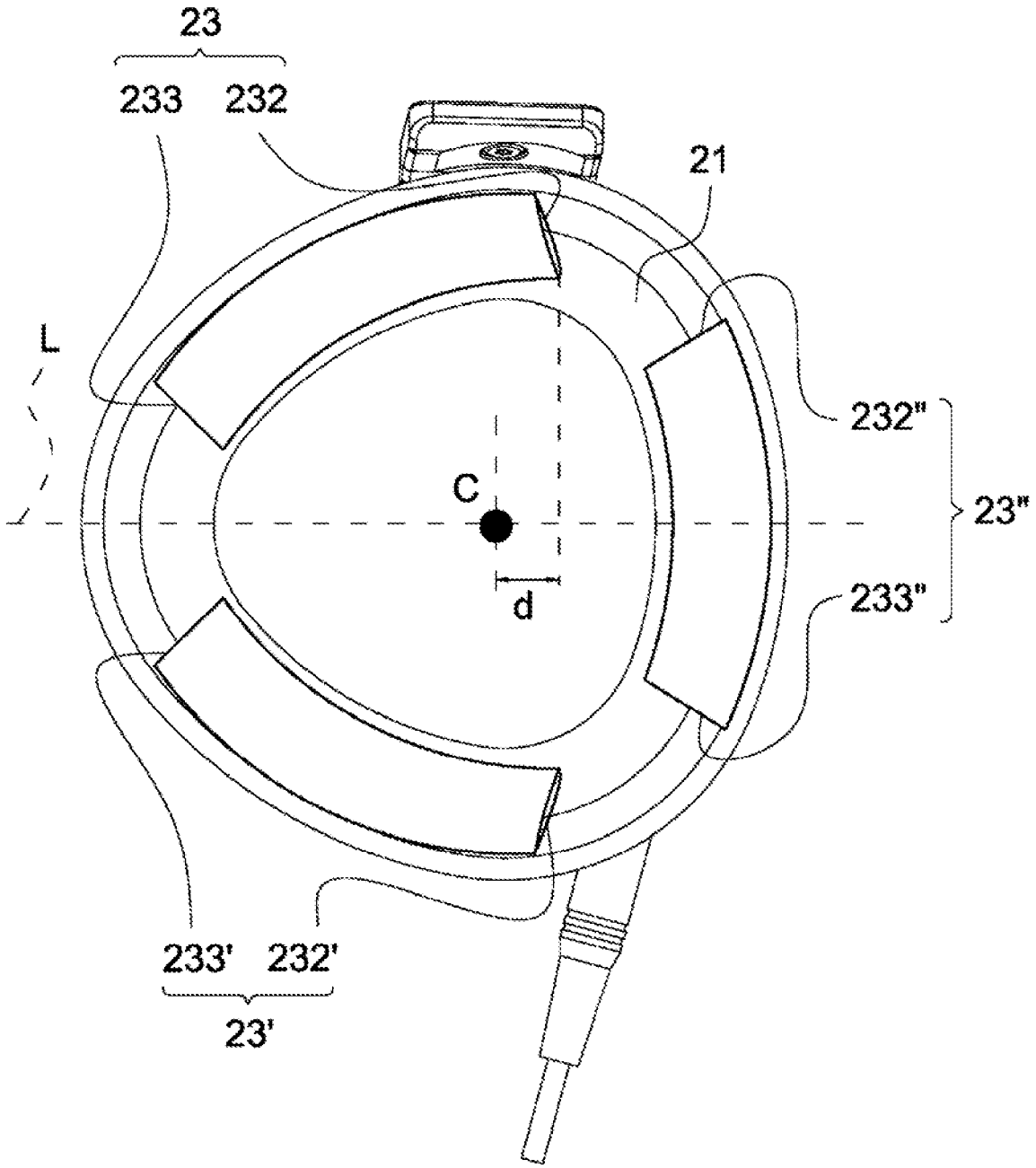
FIG. 6 depicts the arrangement of the tubes (¼ wavelength tubes) of the headphone device of the invention.

The tube 23 shown in FIGS. 1, 2 and 6 is the above-mentioned ¼ wavelength tube which is used for eliminating or reducing the standing wave formed behind the ear, performing the sound positioning in the front, and improving the quality of sound of the headphone device 2. The tube 23 is disposed between the ear cushion 22 and the cover plate 211 and is substantially parallel to the cover plate 211. Alternatively, the tube 23 is disposed at an angle of 1°-20° from the cover plate 211. The tube 23 includes a tubular body 231, a first end 232 and a second end 233. The tubular body 231 is disposed between the first end 232 and the second end 233. The first end 232 and the second end 233 are disposed towards the inner circumferential surface 244 of the connecting portion 24, wherein the first end 232 is open and the second end 233 is closed. In practice, such a tube 23 can be obtained by preparing a tube which has both ends open, and sealing one end by industrial adhesives without sound leakage. Further, the cross section of the tube 23 is in a closed shape, for example circular, square, triangular, or in any suitable shape to meet the practical requirements. The tube 23 may be, for example, a plastic hose.

The tube containing portion 25 is disposed on the third surface 2211 of the compression portion 221 to contain the tube 23. The tube containing portion 25 may be, for example, a leather covering. In assembly, the tube 23 is inserted into the tube containing portion 25 with the first end 232 exposed.

Figure 5:
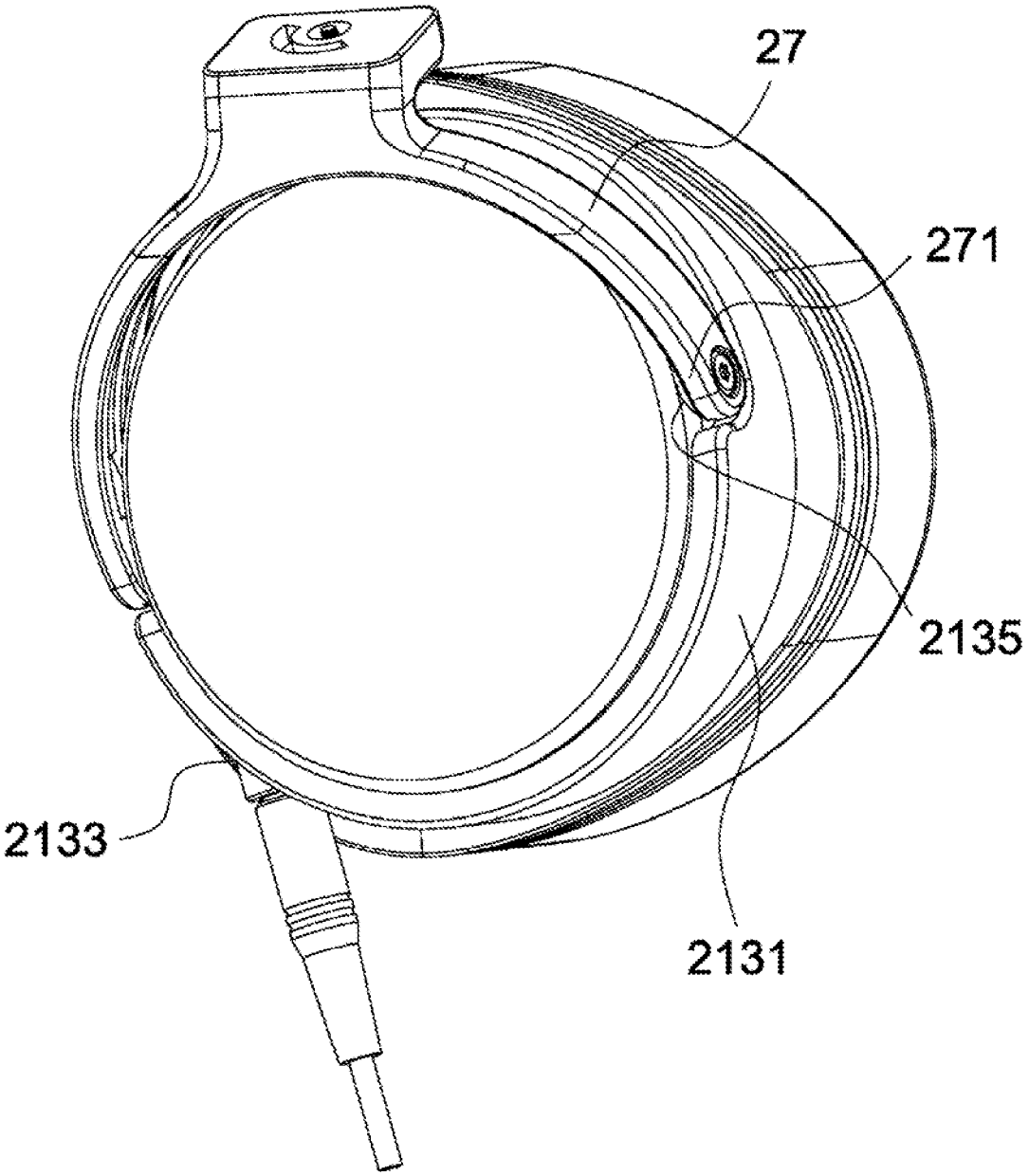
FIG. 5 is a perspective diagram of the headphone device of the invention, showing the arrangement of the mounting hole and the audio cable hole of the main body with respect to the extension support.

FIG. 5 is a perspective diagram of the headphone device of the invention, showing the arrangement of the mounting hole and the audio cable hole of the main body with respect to the extension support. The headphone device 2 of the invention further includes an extension support 27. The extension support 27 includes at least one end portion 271 and extends outside the housing 21 and along the circumferential portion 2131 of the main body 213. The end portion 271 of the extension support 271 is connected to the circumferential portion 2131. The circumferential portion 2131 is provided with an audio cable hole 2133 and a mounting hole 2135. As shown in FIG. 5, the audio cable hole 2133 is located opposite to the extension support 27. The end portion 271 of the extension support 27 is connected to the mounting hole 2135.

In the invention, the number of the tube may be one or two. Further, the tube may be disposed near the extension support 27, the mounting hole 2135 or the audio cable hole 2133. FIG. 6 depicts all feasible locations for the tube. In an embodiment, only one tube 23 is provided and the tube 23 is disposed near the extension support 27. When the headphone device 2 is worn by the user, the tube 23 is disposed over user's ear and the first end 232 of the tube 23 is disposed towards the mounting hole 2135. Therefore, the first end (the open end) is closer to the acoustic channel formed behind user's ear than the second end (the closed end). In another embodiment, only one tube 23' is provided but the tube 23' is disposed near the audio cable hole 2133. When the headphone device 2 is worn by the user, the tube 23' is disposed under user's ear and the first end 232' (the open end) is disposed towards the mounting hole 2135. In yet another embodiment, two tubes 23 and 23' are provided. The tubes 23 and 23' are disposed near the extension support 27 and the audio cable hole 2133, respectively. When the headphone device 2 is worn by the user, the first end 232 and 232' (the open ends) of the tubes 23 and 23' are disposed towards the mounting hole 2135. In further yet another embodiment, only one tube 23" is provided and the tube 23" is disposed near the mounting hole 2135. When the headphone device 2 is worn by the user, the tube 23" is disposed behind user's ear. Either of the first end 232" and the second end 233" is an open end while the other is a closed end. In other words, the first end 232" is an open end and the second end 233" is a closed end. Alternatively, the first end 232" is a closed end and the second end 233" is an open end.

As shown in FIG. 6, the housing 21 of the headphone device 2 has an upper portion and a lower portion identical to each other, and therefore has a symmetrical axis L. The housing 21 further has a central axis C in the direction of thickness (perpendicular to this paper). The symmetrical axis L perpendicularly intersects the central axis C. In some embodiments, edges of the first ends 232 and 232' of the tube 23 and 23' are 10 mm-30 mm away from the central axis C measured along the symmetric axis L. That is, the distance d therebetween measured along the symmetric axis L ranges between 10 mm and 30 mm.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A headphone device, comprising:

a housing comprising a main body and a cover plate, wherein the cover plate comprises a first surface and a second surface, the first surface is disposed towards the main body and connected to the main body so as to form an internal space, and the second surface is disposed opposite to the first surface;

a sound generator disposed in the internal space; and a tube comprising a tubular body, a first end and a second end, wherein the tubular body is disposed between the first end and the second end, and the tubular body has a cross section which is in a closed shape;

wherein the second surface of the cover plate is disposed towards the tubular body;

wherein the tubular body and the second surface are disposed in parallel or have an included angle less than twenty degrees;

wherein the tube is open at the first end and is closed at the second end;

wherein the headphone device satisfies following conditions:

35 mm≤L≤55 mm, and 2 mm≤φ≤4 mm, where L is a length of the tube, and φ is a diameter of the tube.

2. The headphone device as claimed in claim 1, further comprising an extension support, wherein the main body comprises a circumferential portion connected to the first surface of the cover plate, the extension support comprises an end portion connected to the circumferential portion, the extension support extends along the circumferential portion of the main body and outside the housing, the circumferential portion has an audio cable hole disposed opposite to the extension support, and the tube is disposed near the extension support or the audio cable hole.

3. The headphone device as claimed in claim 1, further comprising an extension support and another tube, wherein the main body comprises a circumferential portion connected to the first surface of the cover plate, the extension support comprises an end portion connected to the circumferential portion, the extension support extends along the circumferential portion of the main body and outside the housing, the circumferential portion has an audio cable hole disposed opposite to the extension support, and the tubes are disposed near the extension support or the audio cable hole.

4. The headphone device as claimed in claim 1, further comprising an extension support, wherein the main body comprises a circumferential portion connected to the first surface of the cover plate, the circumferential portion has a mounting hole, the extension support comprises an end portion connected to the mounting hole of the circumferential portion, the extension support extends along the circumferential portion of the main body and outside the housing, and the tube is disposed near the mounting hole.

5. The headphone device as claimed in claim 1, further comprising an extension support and an ear cushion, wherein the main body comprises a circumferential portion connected to the first surface of the cover plate, the circumferential portion has a mounting hole, the extension support comprises an end portion connected to the mounting hole of the circumferential portion, the extension support extends along the circumferential portion of the main body and outside the housing, and an acoustic channel is formed between the ear cushion and the cover plate and near the mounting hole when the headphone device is in use.

6. The headphone device as claimed in claim 5, wherein the first end of the tube is father from the acoustic channel than the second end of the tube.

7. The headphone device as claimed in claim 6, wherein the second end of the tube is closed by glue.

8. The headphone device as claimed in claim 5, satisfying at least one of following conditions:

70 mm≤D1≤116 mm;

30%≤L/D1≤79%, where D1 is a length of the acoustic channel, and L is a length of the tube.

9. The headphone device as claimed in claim 6, satisfying at least one of following conditions:

70 mm≤D1≤116 mm;

30%≤L/D1≤79%, where D1 is a length of the acoustic channel, and L is a length of the tube.

10. The headphone device as claimed in claim 7, satisfying at least one of following conditions:

70 mm≤D1≤116 mm;

30%≤L/D1≤79%, where D1 is a length of the acoustic channel, and L is a length of the tube.

11. The headphone device as claimed in claim 1, further comprising an ear cushion, a connecting portion and a tube containing portion, wherein the ear cushion comprises a compression portion, the compression portion comprises a third surface and a fourth surface, the third surface is disposed towards the second surface, the fourth surface is disposed opposite to the third surface, the connecting portion comprises a third end and a fourth end, the third end is fixed to the compression portion, the fourth end is fixed to the housing, the tube is disposed in the tube containing portion, and the tube containing portion is disposed on the third surface of the compression portion.

12. The headphone device as claimed in claim 1, wherein the housing further comprises a central axis and a symmetric axis, the central axis extends in a direction of thickness of the housing, the symmetric axis perpendicularly intersects the central axis, the tube is open at the first end, and the first end is 10 mm-30 mm away from the central axis measured along the symmetric axis.

13. A headphone device, comprising:

a housing comprising a main body and a cover plate, wherein the cover plate comprises a first surface and a second surface, the first surface is disposed towards the main body and connected to the main body so as to form an internal space, and the second surface is disposed opposite to the first surface;

a sound generator disposed in the internal space;

a tube comprising a tubular body, a first end and a second end, wherein the tubular body is disposed between the first end and the second end, and the tubular body has a cross section which is in a closed shape; and an ear cushion;

wherein the main body comprises a circumferential portion connected to the first surface of the cover plate, and the circumferential portion has a mounting hole;

wherein the second surface of the cover plate is disposed towards the tubular body;

wherein an acoustic channel is formed between the ear cushion and the cover plate and near the mounting hole when the headphone device is in use;

wherein the tube is open at the first end and is closed at the second end;

wherein the headphone device satisfies following conditions:

35 mm≤L≤55 mm, and 2 mm≤φ≤4 mm, where L is a length of the tube, and φ is a diameter of the tube;

wherein the headphone device further satisfies at least one of following conditions:

70 mm≤D1≤116 mm;

30%≤L/D1≤79%, where D1 is a length of the acoustic channel.

14. A headphone device, comprising:

a housing comprising a main body and a cover plate, wherein the cover plate comprises a first surface and a second surface, the first surface is disposed towards the main body and connected to the main body so as to form an internal space, and the second surface is disposed opposite to the first surface;

a sound generator disposed in the internal space;

a tube comprising a tubular body, a first end and a second end, wherein the tubular body is disposed between the first end and the second end, and the tubular body has a cross section which is in a closed shape;

an ear cushion;

a connecting portion; and a tube containing portion;

wherein the second surface of the cover plate is disposed towards the tubular body;

wherein the tubular body and the second surface are disposed in parallel or have an included angle less than twenty degrees;

wherein the ear cushion comprises a compression portion, the compression portion comprises a third surface and a fourth surface, the third surface is disposed towards the second surface, the fourth surface is disposed opposite to the third surface, the connecting portion comprises a third end and a fourth end, the third end is fixed to the compression portion, the fourth end is fixed to the housing, the tube is disposed in the tube containing portion, and the tube containing portion is disposed on the third surface of the compression portion.

15. The headphone device as claimed in claim 14, further comprising an extension support, wherein the main body comprises a circumferential portion connected to the first surface of the cover plate, the extension support comprises an end portion connected to the circumferential portion, the extension support extends along the circumferential portion of the main body and outside the housing, the circumferential portion has an audio cable hole disposed opposite to the extension support, and the tube is disposed near the extension support or the audio cable hole.

16. The headphone device as claimed in claim 14, further comprising an extension support and another tube, wherein the main body comprises a circumferential portion connected to the first surface of the cover plate, the extension support comprises an end portion connected to the circumferential portion, the extension support extends along the circumferential portion of the main body and outside the housing, the circumferential portion has an audio cable hole disposed opposite to the extension support, and the tubes are disposed near the extension support or the audio cable hole.

17. The headphone device as claimed in claim 14, further comprising an extension support, wherein the main body comprises a circumferential portion connected to the first surface of the cover plate, the circumferential portion has a mounting hole, the extension support comprises an end portion connected to the mounting hole of the circumferential portion, the extension support extends along the circumferential portion of the main body and outside the housing, and the tube is disposed near the mounting hole.

18. The headphone device as claimed in claim 14, further comprising an extension support and an ear cushion, wherein the main body comprises a circumferential portion connected to the first surface of the cover plate, the circumferential portion has a mounting hole, the extension support comprises an end portion connected to the mounting hole of the circumferential portion, the extension support extends along the circumferential portion of the main body and outside the housing, an acoustic channel is formed between the ear cushion and the cover plate and near the mounting hole when the headphone device is in use, the first end of the tube is father from the acoustic channel than the second end of the tube, and the tube is open at the first end and is closed at the second end, and the second end of the tube is closed by glue.

19. The headphone device as claimed in claim 14, further comprising an extension support and an ear cushion, wherein the main body comprises a circumferential portion connected to the first surface of the cover plate, the circumferential portion has a mounting hole, the extension support comprises an end portion connected to the mounting hole of the circumferential portion, the extension support extends along the circumferential portion of the main body and outside the housing, an acoustic channel is formed between the ear cushion and the cover plate and near the mounting hole when the headphone device is in use, and the headphone device satisfies at least one of following conditions:

$70\ \text{mm} \leq D1 \leq 116\ \text{mm}$;

$35\ \text{mm} \leq L \leq 55\ \text{mm}$;

$30\% \leq L/D1 \leq 79\%$, where D1 is a length of the acoustic channel, and L is a length of the tube.

20. The headphone device as claimed in claim 14, wherein the housing further comprises a central axis and a symmetric axis, the central axis extends in a direction of thickness of the housing, the symmetric axis perpendicularly intersects the central axis, the tube is open at the first end, and the first end is 10 mm-30 mm away from the central axis measured along the symmetric axis.

* * * * *